US007485822B2

(12) United States Patent
Koyano et al.

(10) Patent No.: US 7,485,822 B2
(45) Date of Patent: Feb. 3, 2009

(54) KEY SHEET

(75) Inventors: Shigeru Koyano, Tokyo (JP); Yutaka Nakanishi, Tokyo (JP); Motoki Ozawa, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 77 days.

(21) Appl. No.: 11/546,341

(22) Filed: Oct. 12, 2006

(65) Prior Publication Data

US 2007/0084709 A1 Apr. 19, 2007

(30) Foreign Application Priority Data

Oct. 13, 2005 (JP) ..... 2005-299474
Aug. 31, 2006 (JP) ..... 2006-236483

(51) Int. Cl.
*H01H 3/12* (2006.01)

(52) U.S. Cl. ..... 200/341; 200/345

(58) Field of Classification Search ..... 200/310–314, 200/341–345; 438/122
See application file for complete search history.

(56) References Cited

U.S. PATENT DOCUMENTS 4,634,824 A * 1/1987 Takano ..... 200/266
4,901,074 A * 2/1990 Sinn et al. ..... 341/22
5,764,483 A 6/1998 Ohashi et al.
2004/0070940 A1* 4/2004 Tomioka et al. ..... 361/699
2004/0170000 A1* 9/2004 Fujiwara et al. ..... 361/719
2004/0228088 A1* 11/2004 Minamitani et al. ..... 361/687
2004/0240174 A1* 12/2004 Ooka et al. ..... 361/687
2005/0158916 A1 7/2005 Hirano et al.
2007/0000642 A1* 1/2007 Yamazaki et al. ..... 165/80.3
2007/0070935 A1* 3/2007 Prakash et al. ..... 370/328
2007/0230120 A1* 10/2007 Hata et al. ..... 361/690

FOREIGN PATENT DOCUMENTS

JP 05-298961 11/1993
JP 2000-311050 11/2000

OTHER PUBLICATIONS

European Search Report, Jan. 30, 2007.

* cited by examiner

*Primary Examiner*—Michael A Friedhofer
*Assistant Examiner*—Lisa N Klaus
(74) *Attorney, Agent, or Firm*—Cermak Kenealy Vaidya & Nakajima LLP; Tomoko Nakajima

(57) ABSTRACT

Disclosed is a key sheet efficiently diffusing local heat generated by a device mounted on a board. A key sheet has a base sheet formed of a rubber-like elastic material in which a heat conductive filler is mixed. Thus, if a semiconductor device on a board generates heat, it is possible to suppress local heat storage by the heat conductive filler of the base sheet. Further, there is no need to provide a separate member for heat diffusion between the board and the key sheet, making it possible to realize a reduction in thickness. Thus, with the key sheet, it is possible to meet the requirement for heat diffusion to eliminate local heat storage in electronic apparatuses, and the requirement for a reduction in the thickness and weight of electronic apparatuses.

25 Claims, 10 Drawing Sheets

KEY SHEET

BACKGROUND OF THE INVENTION

1. Field of the Invention

The present invention relates to a pushbutton switch key sheet for use in various electronic apparatuses, such as a portable information terminal, including: a mobile phone; a personal digital assistant (PDA), a vehicle-mounted AV apparatus, a remote controller, and a personal computer.

2. Description of the Related Art

Many pushbutton switches for various electronic apparatuses, such as a mobile phone and an AV apparatus, are of a construction in which the pushbuttons (i.e., key tops) for performing input operation through depression are exposed through an operation opening formed in the casing of the electronic apparatus. To be specific, it is common practice to place a key sheet having key tops on a board on which contact switches are arranged and to cover the front side of the key sheet with the casing to thereby incorporate the key sheet into the casing.

Electronic apparatuses, whose functions are becoming more and more sophisticated, adopt a construction in which the heat generated within the apparatus is dissipated. This heat is generated by the mounted components, such as semiconductor devices and electronic components, mounted on the board with high density. Above all, the semiconductor devices increase in heat generation amount in accordance with an improvement in processing capacity and an increase in processing capacitance, and if local heat storage is left unattended, there is a fear of a malfunction and failure. Thus, it is necessary for the heat generated around the mounted components to be effectively dissipated to the ambient space without being allowed to locally stay.

As a conventional example of a countermeasure against this heat, a cooling component, such as a heat sink or a cooling fin, is attached to the heat-generating mounted component through the intermediation of a heat conductive sheet, a heat conductive grease, etc. However, while such a countermeasure against heat is taken for the mounting surface side of the board, no sufficient countermeasure against heat has been taken for the back surface side thereof. Thus, as the heat generation amount increases, local heat storage occurs also on the back surface side of the board.

For example, in a portable electronic apparatus, such as a mobile phone, such local heat storage is a serious problem that should be solved as soon as possible. That is, in a portable electronic apparatus, there are mounted many functions involving a large processing load, such as a moving picture reproducing function. Thus, ideally, it is desirable to take such a countermeasure against heat as mentioned above for both sides of the board. However, in view of the fact that there is a demand for a further reduction in the thickness of electronic apparatuses, it is rather difficult to secure the requisite arrangement space for a cooling component, etc. between the key sheet and the board. Further, the fact that the key sheet is a movable component that is movable through depressing operation of the key tops also constitutes a factor making it difficult to cope with the heat between the key sheet and the board.

In this connection, for example, JP 2000-311050 A proposes a countermeasure against heat using a radiation electromagnetic wave absorption shielding plate formed of metal provided between a board contained in a keyboard and key tops for input operation, and a graphite sheet attached to this shielding plate. However, as stated above, in a portable electronic apparatus, in particular, of which a further reduction in thickness is required, there is no room left between the board and the key sheet for such a large gap as would allow taking a countermeasure against heat.

SUMMARY OF THE INVENTION

The present invention has been made in view of the above problem in the prior art. It is accordingly an object of the present invention to propose a technique allowing efficient diffusion of the local heat generated by the mounted components on the board.

To solve the above-mentioned problems, the present invention provides a key sheet including a depression operating portion, a base sheet which is placed on a circuit board with a heat generating electronic component mounted thereon and which is formed of a rubber-like elastic material, in which the base sheet has a heat diffusion member promoting diffusion of heat generated by the electronic component in a face direction of the base sheet.

According to the present invention, a key sheet which has a depression operating portion and is equipped with a base sheet formed of a rubber-like elastic material placed on a circuit board with a heat generating electronic component mounted thereon, has a heat diffusion member promoting diffusion, in the face direction of the base sheet, of the heat generated by the heat generating component. That is, the structure of the key sheet itself is such that the base sheet thereof is provided with a heat diffusion member. Thus, if no heat diffusion member is mounted between the board and the key sheet, the local heat generated by the mounted component on the board can be efficiently diffused in the face direction of the base sheet by the heat diffusion member of the base sheet. Thus, the key sheet of the present invention can meet both the requirement for heat diffusion and the requirement for a reduction in the thickness of electronic apparatuses.

Roughly speaking, the heat diffusion member with which the base sheet is provided may be realized in two forms. As described below, in one form, the heat diffusion member may be realized as a heat conductive filler mixed in the rubber-like elastic material constituting the material of the base sheet. In the other form, the heat diffusion member may be realized as a heat conductive sheet which is separate from the base sheet formed of the rubber-like elastic material. More specifically, the heat diffusion member may be formed of a thin metal plate or a graphite sheet as described below.

The present invention provides a key sheet, in which the heat diffusion member is a heat conductive filler mixed in the rubber-like elastic material of the base sheet.

According to the present invention, the heat diffusion member is realized as a heat conductive filler mixed in the rubber-like elastic material of the base sheet, so there is no need to integrate the base sheet with a separate member for heat diffusion, whereby a reduction in thickness can be achieved and the production is facilitated. Further, it is also possible to orient the heat conductive filler by a high magnetic field, making the heat conductivity higher in the face direction than in the thickness direction of the base sheet. As the heat conductive filler, it is possible to select and use at least one of the following: carbon material, metal nitride, metal oxide, metal carbide, and metal hydroxide.

The present invention provides a key sheet, in which the heat diffusion member is a thin metal plate with which the base sheet is integrally provided.

According to the present invention, the heat diffusion member is formed of a thin metal plate provided integrally with the base sheet, so it is possible to enhance the mechanical strength, thus preventing distortion, etc. of the base sheet.

Further, since insert molding is possible, the integration of the heat diffusion member with the base sheet formed of a rubber-like elastic material can be effected easily by molding. Further, when the key sheet is endowed with an illuminating function for illuminating the key tops, the thin metal plate efficiently reflects the light emanated from an illumination light source mounted on the board, so it is possible to realize a bright illumination of the translucent key tops.

The present invention provides a key sheet, in which the heat diffusion member is a thin graphite sheet with which the base sheet (16) is integrally provided.

According to the present invention, the heat diffusion member is formed of a graphite sheet provided integrally with the base sheet, so high heat conductivity is provided, making it possible to effect heat diffusion efficiently. Further, the graphite sheet is lightweight, which helps to meet the requirement for a reduction in the weight of portable electronic apparatuses.

The present invention provides a key sheet, in which the heat diffusion member is a laminate composed of a thin metal plate and a graphite sheet.

According to the present invention, the heat diffusion member is formed of a laminate composed of a thin metal plate and a graphite sheet. Thus, due to the thin metal plate, it is possible to suppress breakage and chipping of the graphite sheet, which is rather fragile, and to compensate for the low physical strength of the graphite sheet. The thin metal plate and the graphite sheet may be laminated directly or indirectly.

The laminate composed of a thin metal plate and a graphite sheet, it may be composed of a thin metal plate which is located on the side of a circuit board and a graphite sheet which is located on the opposite side of a circuit board. In other words, it may be laminated a thin metal plate on the back surface side.

Since the laminate is composed of a thin metal plate which is located on the side of a circuit board and a graphite sheet which is located on the opposite side of a circuit board, as compared with the case in which a thin metal plate is located on the opposite side of a circuit board, it is possible to enhance heat diffusion efficiency.

The present invention provides a key sheet, in which the heat diffusion member is provided with a polymer protective layer covering at least one surface thereof.

According to the present invention, a polymer protective layer is provided on at least one side of the graphite sheet, the thin metal plate, or the laminate of the graphite sheet and the thin metal plate, so the graphite sheet, which is physically fragile, does not easily suffer breakage or chipping. Further, it is possible to protect the surface of the thin metal plate. Further, the bondage between the polymer protective layer and the base sheet is enhanced. Thus, as compared with the case in which the graphite sheet, etc. are handled singly in the key sheet producing process, handling is facilitated, and the key sheet can be easily integrated with the base sheet. At the time of mounting, the heat conduction path is cut off when breakage or chipping occurs in the graphite sheet, resulting in a deterioration in heat conduction efficiency. However, due to the provision of the polymer protective layer, it is possible to restrain the cut-off of the heat conduction path attributable to breakage or chipping, thus making it possible to prevent a deterioration in the heat diffusion promoting effect.

The present invention provides a key sheet, in which the heat diffusion member is provided with a polymer protective layer covering the heat diffusion member as a whole.

According to the present invention, there is provided a polymer protective layer covering the graphite sheet, the thin metal plate, or the laminate of the graphite sheet and the thin metal plate as a whole, so not only the both sides but also the end portions of the graphite sheet, etc. are covered and sealed, so, even when the graphite sheet is broken or chipped, it is possible to completely prevent a fragment of the graphite sheet from falling and to prevent oxidation, etc. of the thin metal plate.

In the present invention, the polymer protective layer of the key sheet is a resin film. Thus, breakage does not easily occur even after repeated deformation, thus making it possible to reliably protect the graphite sheet. Further, it is possible to achieve a reduction in the thickness and weight of the base sheet.

In the present invention, the polymer protective layer of the key sheet is a coating layer. Thus, it is possible to reliably protect the graphite sheet. Further, it is possible to achieve a reduction in the thickness and weight of the base sheet.

The present invention provides a key sheet, in which the depression operating portion is a key top formed of a translucent resin, the rubber-like elastic material of the base sheet is translucent, base sheet has a float-supporting portion supporting the key top so as to allow displacement through depression, and the heat diffusion member is provided in a portion of the base sheet excluding the float-supporting portion.

According to the present invention, the translucent key top is provided on the float-supporting portion of the translucent base sheet, and the heat diffusion member is provided on the remaining portion of the base sheet excluding the float-supporting portion. Thus, when the light source for illumination is arranged on the back surface of the base sheet, the light from the light source can pass through the float-supporting portion and illuminate the key top, thus realizing an illumination type key sheet.

According to the present invention, in the key sheet as described above, the polymer protective layer serves as a light diffusion layer for diffusing light from an illumination light source mounted on the board.

According to the present invention, there is provided a light diffusion layer for diffusing light, so the light diffusion layer diffuses light before the light reaches the dark-colored heat diffusion member. Thus, it is possible to suppress light absorption by the heat diffusion member, such as a graphite sheet. Further, by diffusing light to the ambient space, it is possible to realize an illumination type key sheet in which the key tops are brightly illuminated.

In the key sheet of the present invention, the base sheet itself is equipped with a heat diffusion member, so if no heat diffusion member is mounted between the board and the key sheet, it is possible to efficiently diffuse, in the face direction of the base sheet, the local heat generated from the components mounted on the board by means of the base sheet. Thus, the key sheet of the present invention proves effective for a small electronic apparatus with a large heat generation amount, in particular, a portable electronic apparatus, making it possible to prevent occurrence of a problem such as a malfunction or failure of the mounted components.

The above description of this invention should not be construed restrictively. The advantages, features, and uses of this invention will become more apparent from the following description given in connection with the accompanying drawings. Further, it should be understood that all the appropriate modifications made without departing from the gist of this invention are covered by the scope of this invention.

BRIEF DESCRIPTION OF THE DRAWINGS

In the accompanying drawings.

DESCRIPTION OF THE PREFERRED EMBODIMENTS

Figure 1:
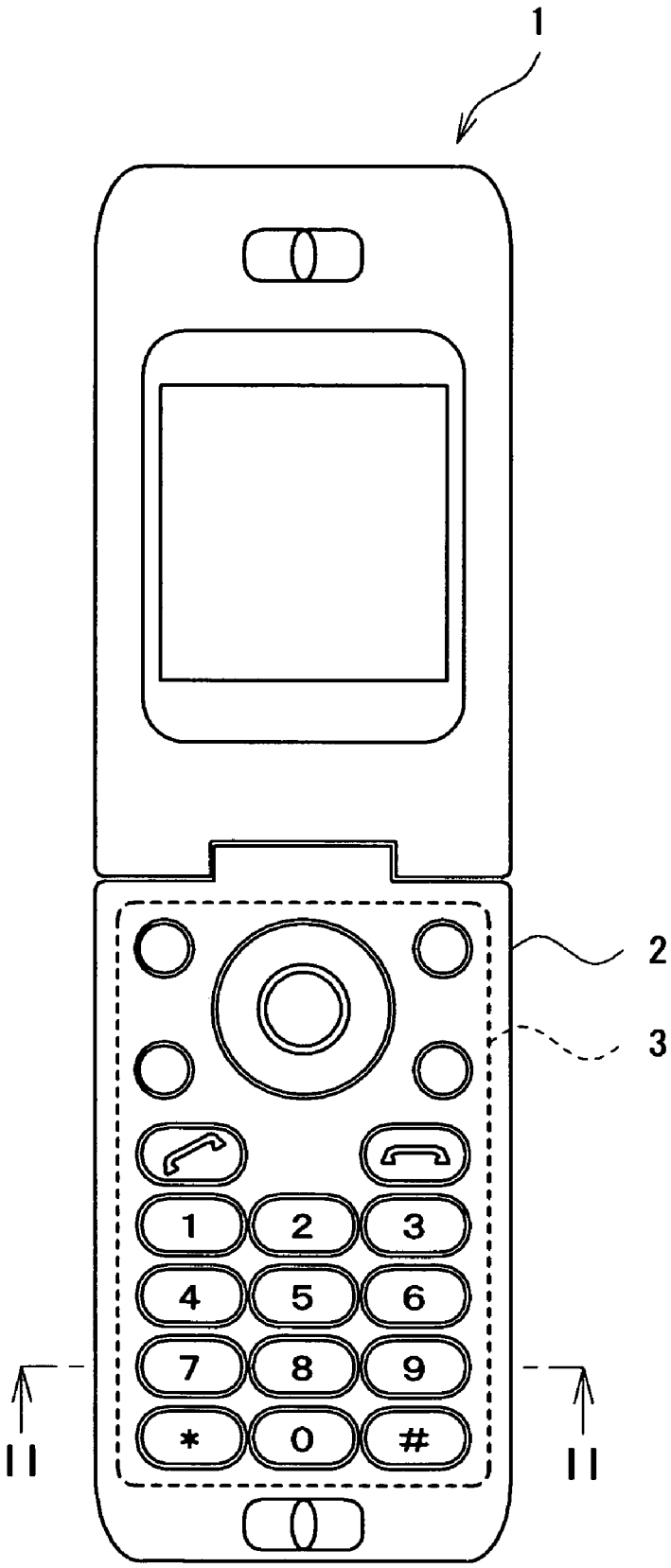
FIG. 1 is an external view of a mobile phone equipped with a key sheet according to a first embodiment.

In the following, embodiments of the present invention will be described with reference to the drawings. In the drawings, reference numerals indicate portions and components. The portions and components common to the embodiments are indicated by the same reference numerals, and a redundant description thereof will be omitted.

In the following embodiments described below, the present invention is applied to a key sheet incorporated into a casing (2) of a mobile phone (1) as shown in FIG. 1.

Figure 2:
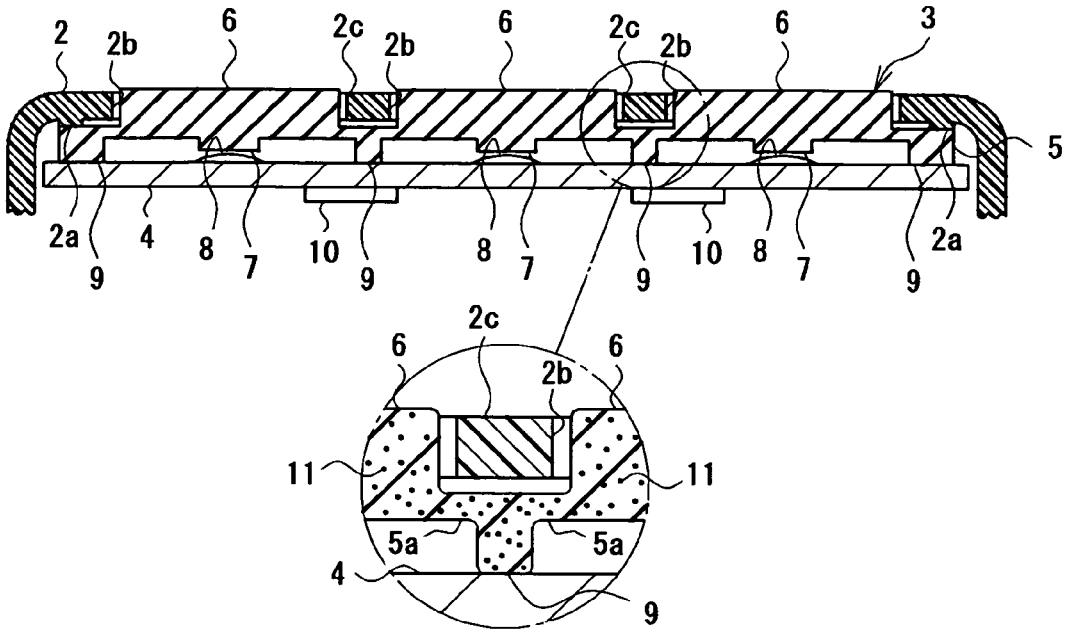
FIG. 2 is an enlarged main-portion sectional view taken along the line II-II of FIG. 1.

First Embodiment (FIGS. 1 and 2)

A key sheet (3) is mounted so as to be held between the casing (2) and a board (4) of the mobile phone (1) in a pressurized state. The key sheet (3) is equipped with a base sheet (5) formed of a rubber-like elastic material. The base sheet (5) has, on the front surface constituting the operating surface, a plurality of key top portions (6) as "depression operating portions" protruding in an elongated-column-like fashion. Around the key top portions (6), there are formed float-supporting portions (5*a*) enabling the key top portions (6) to be displaced through depression. The entire outer periphery of the front surface of the base sheet (5) is pressurized by a retaining portion (2*a*) protruding from the inner surface of the casing (2). On the back surface of the base sheet (5) facing the board (4), there are formed columnar pusher portions (7) respectively for the key top portions (6). The pusher portions (7) are portions for depressing contact switches (8) on the board (4). Further, from the back surface of the base sheet (5), there protrude leg portions (9) over the entire outer periphery and between the adjacent key top portions (6), with the distal ends thereof being in contact with the front surface of the board (4).

On its front surface facing the base sheet (5), the board (4) has the contact switches (8) formed of metal belleville springs. On the back surface of the board (4), semiconductor devices (10) are mounted.

The casing (2) has operation openings (2*b*) formed respectively for the key top portions (6), with the operation openings (2*b*) being partitioned by a partition frame (2*c*).

The base sheet (5) is a molding formed of a rubber-like elastic material in which a heat conductive filler (11) as the "heat diffusion member" is dispersed. In view of the thermal characteristic and flexibility of the molding, the content proportion of the heat conductive filler (11) preferably ranges from 5 vol % to 60 vol %. When the content proportion of the heat conductive filler (11) is less than 5 vol %, the dispersion state is too sparse, and effective heat conduction by the base sheet is impossible. On the other hand, when the content proportion exceeds 60 vol %, the requisite flexibility of the base sheet for a nimble depressing operation of the key tops (6) is lost.

Next, a method of manufacturing the base sheet (5) will be described. First, the heat conductive filler (11) is added to an uncured rubber composition, and the resultant mixture is kneaded by using a kneader, thereby obtaining a rubber composition in which the heat conductive filler (11) is uniformly dispersed. Next, this rubber composition is molded and cured in a mold, whereby the base sheet (5) in which the heat conductive filler (11) is uniformly dispersed is obtained. By applying a high magnetic field to the rubber composition before molding and curing in the mold, it is possible to orient the heat conductive filler (11) contained in the rubber composition in a specific direction. This makes it possible to make the heat conductivity in the face direction of the base sheet (5) higher than that in the thickness direction thereof.

Here, the materials of the components of the key sheet (3) will be described. The following description is commonly applicable to the other embodiments described below.

A material for "rubber-like elastic body" is preferably a rubber or a thermoplastic elastomer each having high impact resilience. In a case of a rubber, a natural rubber, a silicone rubber, an ethylene-propylene rubber, a butadiene rubber, an isoprene rubber, a chloroprene rubber, a urethane rubber, or the like may be used. In a case of a thermoplastic elastomer, a styrene-based thermoplastic elastomer, an olefin-based thermoplastic elastomer, an ester-based thermoplastic elastomer, a urethane-based thermoplastic elastomer, an amide-based thermoplastic elastomer, a butadiene-based thermoplastic elastomer, an ethlylene-vinyl acetate-based thermoplastic elastomer, a fluoro-rubber-based thermoplastic elastomer, an isoprene-based thermoplastic elastomer, a chlorinated polyethylene-based thermoplastic elastomer, or the like may be used. Of those, a silicone rubber, a styrene-based thermoplastic elastomer, and an ester-based thermoplastic elastomer are preferable materials from viewpoints of excellent impact resilience and an excellent durability.

For a material for the thermal conductive filler (11), there can be used at least one kind of materials selected from the group consisting of: a carbon material such as a carbon fiber, a carbon nanotube, a vapor phase grown fine carbon fiber, or a graphite particle; a metal nitride such as boron nitride, aluminum nitride, or silicon nitride; a metal oxide such as aluminum oxide, magnesium oxide, or zinc oxide; a metal carbide such as titanium carbide or chromium carbide; and a metal hydroxide such as aluminum hydroxide or magnesium hydroxide. Of those, boron nitride, aluminum oxide, and aluminum hydroxide can preferably be used as the materials from viewpoints of excellent translucency and high environmental stability.

Next, the effects of the key sheet (3) of this embodiment will be described.

The base sheet (5) of the key sheet (3) is a molding in which the heat conductive filler (11) is uniformly dispersed, so it is possible to diffuse heat in the face direction of the base sheet (5). Thus, even if the semiconductor devices (10) on the board (4) generate heat, this heat is conducted and diffused in the face direction by the base sheet (5) held in contact with the front surface of the board (4), making it possible to prevent local heat storage around the semiconductor devices (10) on the board (4). Thus, it is possible to prevent a malfunction and failure of the semiconductor devices (10).

Since the base sheet (5) itself of the key sheet (3) is provided with a heat diffusion member, it is possible to diffuse heat efficiently in the face direction of the base sheet (5) without having to mount a heat diffusion member between the board (4) and the key sheet (3). Thus, it is possible to meet the requirement for a reduction in the thickness of the mobile phone (1).

In the key sheet (3), the base sheet (5) is formed of a rubber-like elastic material, so even when the heat conductive filler (11) is uniformly dispersed within the base sheet (5), the key sheet (3) is flexible and is superior in rebound resilience and flex resistance. Thus, it is possible to realize a base sheet (5) of high durability allowing reliable input operation for a long period of time.

Figure 3:
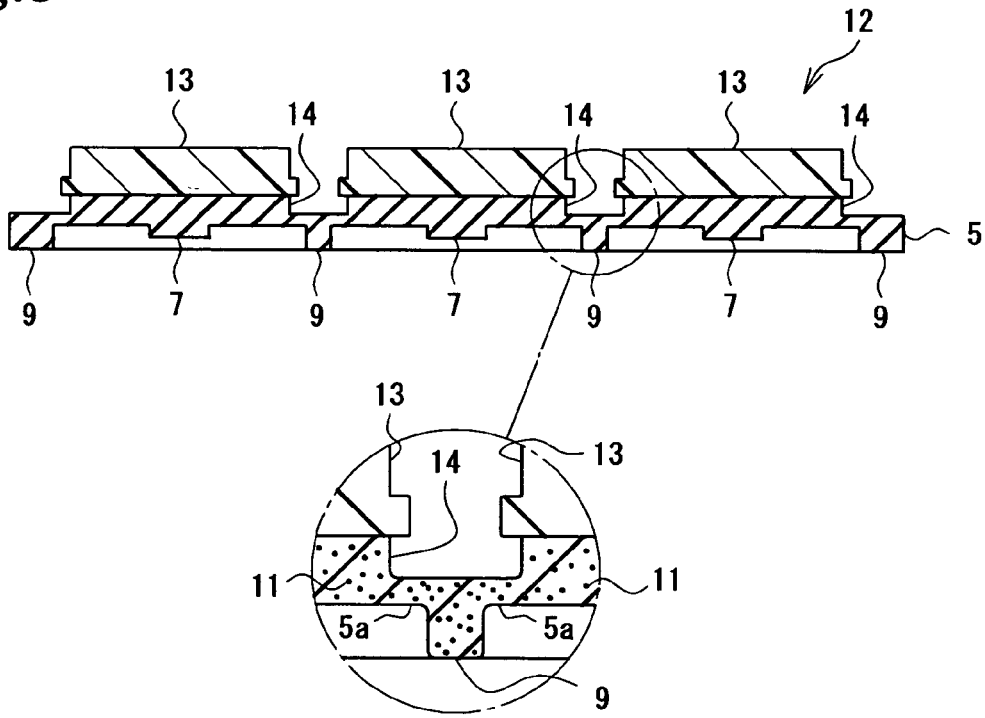
FIG. 3 is a sectional view of a key sheet according to a second embodiment.

Second Embodiment (FIG. 3)

A key sheet (12) according to the second embodiment differs from the key sheet (3) of the first embodiment in that the base sheet (5) is equipped with key tops (13) serving as the "depression operating portions". Otherwise, the key sheet (12) is of the same construction as the first embodiment.

The base sheet (5) has pedestal portions (14) on the front surface constituting the operating surface, and key tops (13), formed of hard resin, are firmly attached thereto by an adhesive (not shown). Around pedestal portions (14), there are formed float-supporting portions (5*a*) enabling the pedestal portions (14) to be displaced through depression.

Like the key sheet (3) of the first embodiment, the key sheet (12) of the second embodiment can prevent a malfunction and failure of the semiconductor devices (10) due to heat diffusion and meet the requirement for a reduction in the thickness of electronic apparatuses. Further, the key sheet (12) provides the following effects. Since the key sheet (12) is equipped with the key tops (13) formed of hard resin, the operation load at the time of depressing operation is not lightened, and it is possible to accurately transmit the operation load on the contact switches (6) (not shown) to an operator, making it possible for the operator to experience a clear input feel. Further, it is also possible to provide a decorating layer, such as a metallic plating layer or a coating layer, making it possible to realize a key sheet (12) superior in design property.

Figure 4:
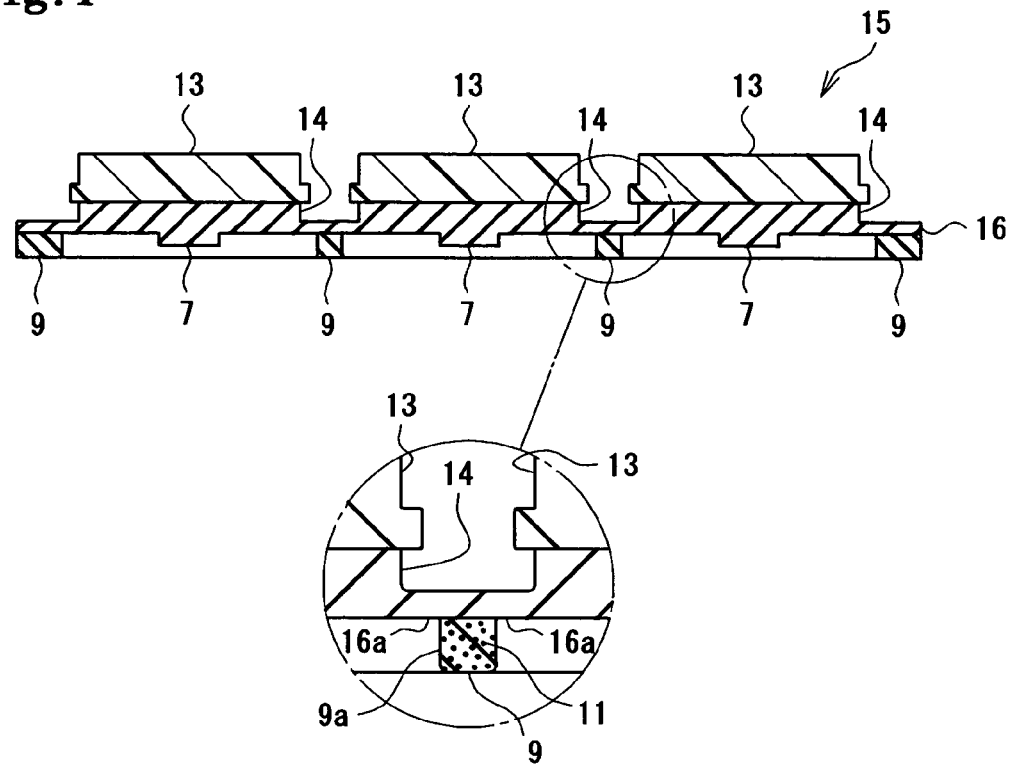
FIG. 4 is a sectional view of a key sheet according to a third embodiment.
Figure 5:
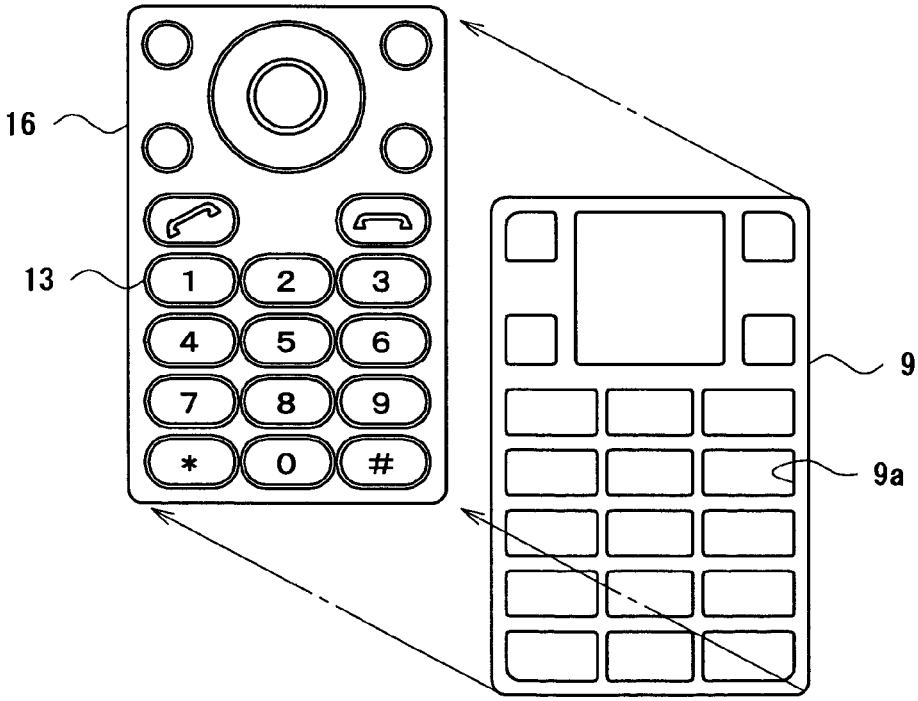
FIG. 5 is an explanatory view of the key sheet of the third embodiment.

Third Embodiment (FIGS. 4 and 5)

A key sheet (15) according to the third embodiment differs from the key sheet (12) of the second embodiment in that it is equipped with a base sheet (16) and leg portions (9) that are separate members from the base sheet (16). Otherwise, the key sheet (15) is of the same construction as the second embodiment.

Like the base sheet (5) of the second embodiment, the base sheet (16) is a molding of a rubber-like elastic material. However, inner portions of the base sheet (16), such as the pedestal portions (14) and float-supporting portions (16*a*) allowing displacement of the pedestal portions (14) through depression, contain no heat conductive filler (11). Further, on the back surface of the base sheet (16), there are provided no such leg portions (9) as a part of the rubber-like elastic material of the base sheet (16) that are in contact with the front surface of the board (4) as shown with reference to the first embodiment.

Instead, the leg portions (9) of this embodiment are moldings of a rubber-like elastic material which are separate members from the base sheet (5) and in which the heat conductive filler (11) are uniformly dispersed. As shown in FIG. 5, there are formed, in correspondence with the pedestal portions (14) of the base sheet (16), through-holes (9*a*) penetrating in the thickness direction. The surfaces of the leg portions (9) opposed to the base sheet (16) are bonded to the base sheet (16) by adhesion, and their surfaces opposite thereto are placed on the front surface of the board (4) (not shown) as in the first embodiment.

Like the key sheet (3) of the first embodiment, the key sheet (15) of the third embodiment described above can prevent a malfunction and failure of the semiconductor devices (10) due to heat diffusion and meet the requirement for a reduction in the thickness of electronic apparatuses. Further, like the key sheet (12) of the second embodiment, the key sheet (15) provides a clear input feel and a rich design property. In addition, the key sheet (15) provides the following effect.

In the key sheet (15) of this embodiment, the leg portions (9), which are separate members from the base sheet and in which the heat conductive filler (11) is uniformly dispersed, are bonded to the back surface of the base sheet (16) by adhesion. Thus, the leg portions (9) diffuse heat in the face direction of the base sheet (16), and if the semiconductor devices (10) provided on the back surface of the board (4) generate heat, the leg portions (9) that are in contact with the front surface of the board (4) conduct and diffuse the heat in the face direction of the base sheet (16), making it possible to prevent local heat storage around the semiconductor devices (10) on the board (4). Thus, it is possible to prevent a malfunction and failure of the semiconductor devices (10).

In the key sheet (15) of this embodiment, the base sheet (16) and the leg portions (9) are formed as separate members. Since the leg portions (9) need not be flexible, it is possible to increase the content of the heat conductive filler (11) in the leg portions (9). Thus, it is possible to enhance the heat conductivity of the leg portions (9), making it possible to effect heat diffusion more efficiently.

Description of sheet-like heat diffusion members according to various embodiments: while the "heat diffusion member" of the first through third embodiments is obtained by uniformly dispersing the heat conductive filler (11) in a rubber-like elastic material, it is also possible, as stated above, to realize the "heat diffusion member" as a sheet-like heat diffusion member (17) utilizing a thin metal plate or a graphite sheet. This will be described in advance.

As shown in the sectional views of FIGS. 6A through 6F, the heat diffusion member (17) can be realized in various forms in which a polymer protective layer (18) is equipped. A thin metal plate and a graphite sheet have electrical conductivity, so it is possible to utilize the polymer protective layer (18) as an electrical insulating layer. A graphite sheet is physically fragile, but in this connection, the polymer protective layer (18) can make the graphite sheet less subject to breakage and chipping.

Figure 6A:
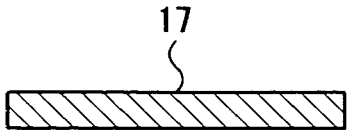
FIG. 6A through 6F are explanatory views of sheet-like heat diffusion members according to various embodiments.

FIG. 6A shows a form in which a thin metal plate or a graphite sheet is used alone as the heat diffusion member (17).

Figure 6B:
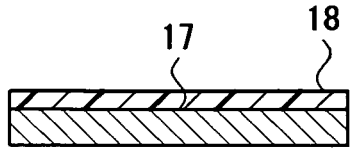

FIG. 6B shows a form in which the upper surface of the heat diffusion member (17) is covered with the polymer protective layer (18). In this form, if the key top is sunk through depressing operation, the heat diffusion member (17) is not touched, so it is possible to protect the heat diffusion member (17) from damage.

Figure 6C:
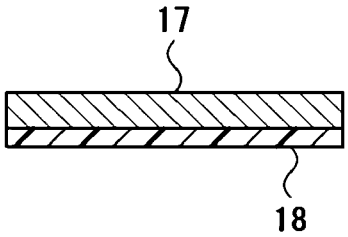

FIG. 6C shows a form in which the lower surface of the heat diffusion member (17) is covered with the polymer protective layer (18). If the heat diffusion member (17), which has electrical conductivity, comes into contact with a plurality of wirings on the board, there is a fear of short-circuiting, which may lead to generation of a malfunction of the circuit, etc. In this form, the heat diffusion member (17) is not in direct contact with the board, so it is advantageously possible to place the heat diffusion member (17) as it is without covering the board surface with an insulating layer.

Figure 6D:
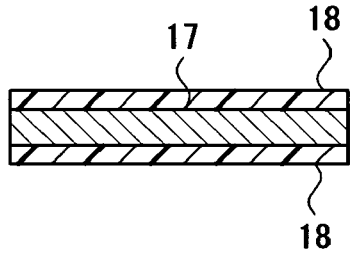

FIG. 6D shows a form in which the upper surface and the lower surface of the heat diffusion member (17) are covered with the polymer protective layers (18). In this form, it is possible to obtain the advantages of the forms shown in FIGS. 6B and 6C.

Figure 6E:
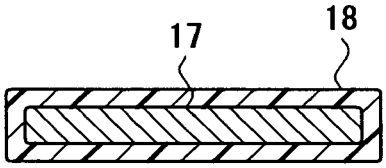

FIG. 6E shows a form in which the entire heat diffusion member (17) is covered with a coating layer as the polymer protective layer (18). In this form, the entire heat diffusion member (17) is sealed by the polymer protective layer (18), so it is possible to completely prevent detachment of an end portion of the heat diffusion member (17).

Figure 6F:
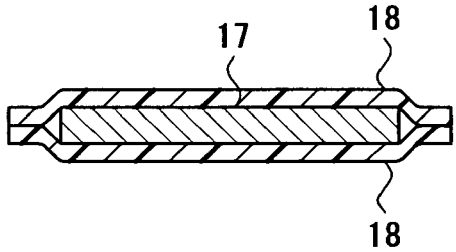

FIG. 6F shows a form in which the entire heat diffusion member (17) is covered by being sandwiched between two upper and lower resin films as the polymer protective layers (18). As in the form of FIG. 6E, in this form, it is possible to completely prevent detachment of an end portion of the heat diffusion member (17).

Here, the material of the polymer protective layer (18) shown in FIGS. 6B through 6F will be described.

It is desirable for the material of the polymer protective layer (18) to be a resin film or a coating film superior in flexing resistance so that no crack may be generated due to the deformation as a result of input operation. Examples of the resin film that can be used include films of polyethylene terephthalate, polybutyrene terephthalate, polycarbonate, polyimide, polyurethane, polyethylene, and polypropylene. The resin film may be integrated with the heat diffusion member through the intermediation of an adhesive layer or through dry lamination. Examples of the material of the coating film that can be used include urethane type paint, epoxy type paint, imide type paint, acrylic paint, fluorine type paint, and silicone type paint. The coating film may be formed through application of a paint selected from the above-mentioned ones.

The polymer protective layer (18) may be formed as one also serving as a light diffusion layer. That is, it is possible to use a resin film obtained by mixing a material, such as polyethylene terephthalate, polybutyrene terephthalate, polycarbonate, polyimide, polyurethane, polyethylene, or polypropylene, with a light diffusion filler, such as white pigment, glass beads, or resin beads. In this case, it is also possible to use a resin film improved in terms of light diffusion property through blasting or embossing of the surface. Further, it is possible to use a transparent resin film whose surface has been subjected to blasting or embossing. Further, it is also possible to adopt a coating layer obtained through immersion, application, or printing, using a paint or an ink mixed with a light diffusion filler.

While in the following embodiments of each of the key sheets, some of the various embodiments of the sheet-like heat diffusion member (17) shown in FIGS. 6A through 6F are taken as examples, it is naturally also possible to carry out the following embodiments with the examples taken therein replaced by other forms shown in FIGS. 6A through 6F.

Figure 7:
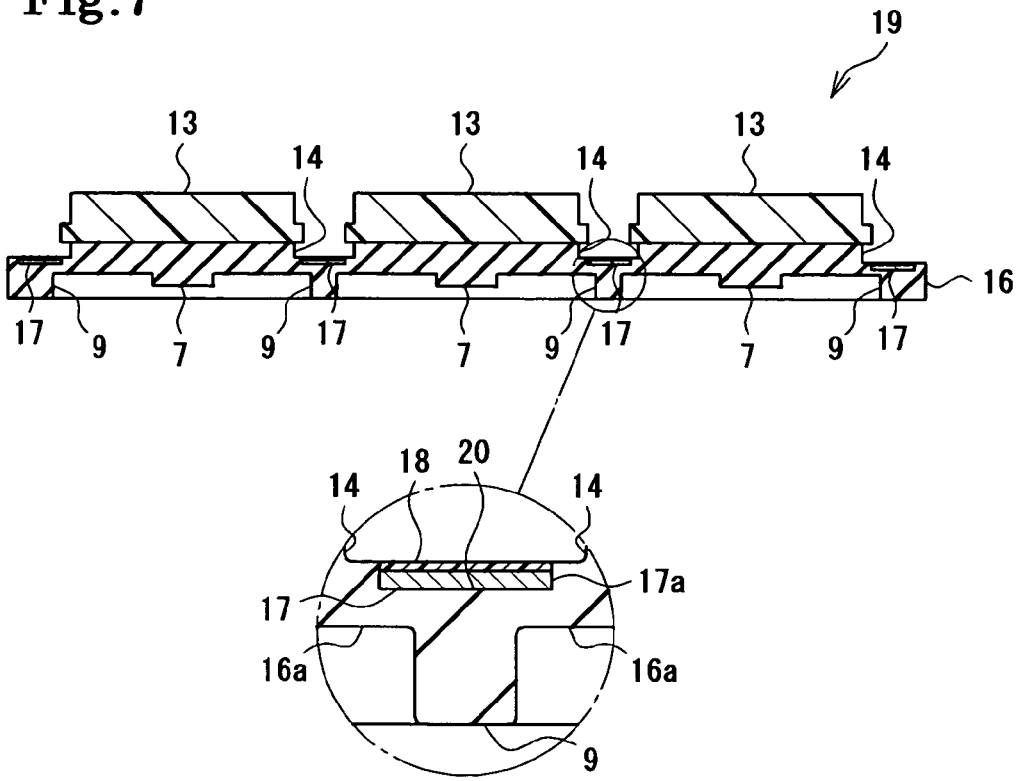
FIG. 7 is a sectional view of a key sheet according to a fourth embodiment.
Figure 8:
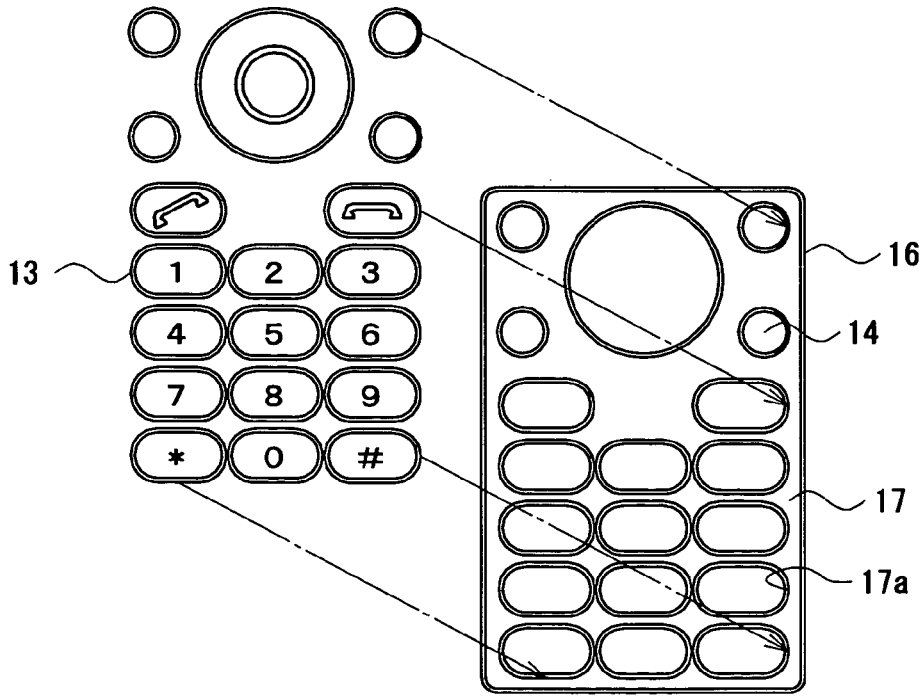
FIG. 8 is an explanatory view of the key sheet of the fourth embodiment.

Fourth Embodiment (FIGS. 7 and 8)

A key sheet (19) according to a fourth embodiment differs from the key sheet (15) of the third embodiment in the structure of the base sheet (16) and in the construction in which the base sheet (16) is equipped with the heat diffusion member (17). Otherwise, the key sheet (19) is of the same construction as the third embodiment.

Around the pedestal portions (14) on the front surface of the base sheet (16), there is provided a fixation recess (20) corresponding to the heat diffusion member (17). The heat diffusion member (17) is bonded to the fixation recess (20) by adhesion. On the back surface of the base sheet (16), there are provided the leg portions (9) protruding over the entire outer periphery of the base sheet (16) and between the adjacent pedestal portions (14). The distal ends of the leg portions (9) are in contact with the front surface of the board. As in a case of the base sheet (5) described above, the base sheet (16), which has the pedestal portions (14) and float-supporting portions (16*a*) allowing displacement of the pedestal portions (14) through depression, may be formed as a molding in which the heat conductive filler (11) is uniformly dispersed.

The heat diffusion member (17) is formed of a single graphite sheet. As shown in FIG. 8, the outer peripheral edge of the heat diffusion member (17) is somewhat smaller than the outer peripheral edge of the base sheet (16), and there are provided through-holes (17*a*) extending through the thickness in correspondence with the pedestal portions (14) of the base sheet (16). The polymer protective layer (18) formed of a resin film is attached to the front surface of the heat diffusion member (17). The heat diffusion member (17) is bonded to the fixation recess (20) of the base sheet (16) by adhesion. Since the heat diffusion member (17) formed of a graphite sheet has electrical conductivity, it is desirable to connect the heat diffusion member (17) to the zero-volt electric power line of the apparatus as a countermeasure against noise.

Like the key sheet (3) of the first embodiment, the key sheet (19) of the fourth embodiment can prevent a malfunction and failure of the semiconductor devices (10) due to heat diffusion, and meet the requirement for a reduction in the thickness of electronic apparatuses. Further, like the key sheet (15) of the third embodiment, the key sheet (19) provides a clear input feel and a rich design property. Further, the key sheet (19) provides the following effects.

In the key sheet (19) of this embodiment, the heat diffusion member (17) is formed of a molding in the form of a graphite sheet, so the key sheet (19) exhibits high heat conductivity and can effect heat diffusion efficiently. Further, due to lightweight properties, the key sheet (19) can meet the requirement for a reduction in the weight of portable apparatuses.

The key sheet (19) of this embodiment is equipped with the heat diffusion member (17) on the surface of which the polymer protective layer (18) is provided. Thus, even if the key tops (13) come into contact therewith during depressing operation, the heat diffusion member (17) is not easily damaged, thus providing high durability.

Figure 9:
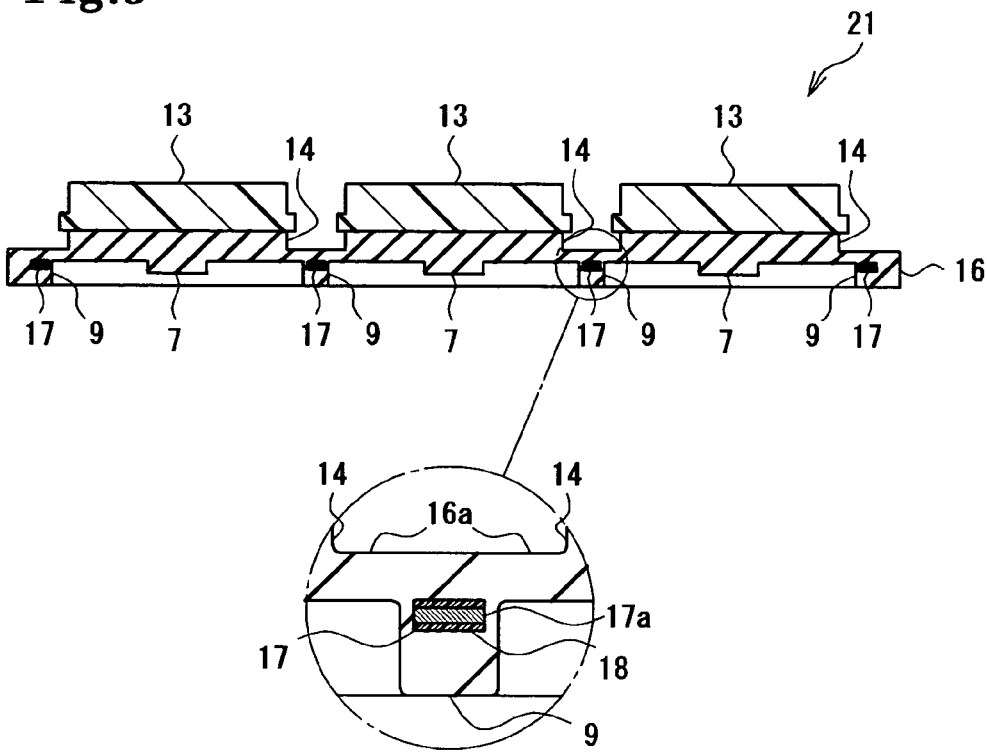
FIG. 9 is a sectional view of a key sheet according to a fifth embodiment.

Fifth Embodiment (FIG. 9)

A key sheet (21) according a the fifth embodiment differs from the key sheet (19) of the fourth embodiment in the structure of the base sheet (16) and in the mounting structure for the heat diffusion member (17). Otherwise, the key sheet (21) is of the same construction as the fourth embodiment On the base sheet (16), there is provided no such fixation recess (20) as seen on the surface of the base sheet (16) of the fourth embodiment. Instead, the heat diffusion member (17) is embedded in the leg portions (9).

The heat diffusion member (17) has the same plan-view configuration as that of the fourth embodiment; the polymer protective layers (18) formed of resin films are attached to the front surface and the back surface of the graphite sheet.

Like the key sheet (3) of the first embodiment, the key sheet (21) of the fifth embodiment prevents a malfunction and failure of the semiconductor devices (10) due to heat diffusion, and can meet the requirement for a reduction in the thickness of electronic apparatuses. Further, like the key sheet (19) of the fourth embodiment, the key sheet (21) provides a clear input feel and a rich design property, and can meet the requirement for a reduction in the weight of portable apparatuses; further, the key sheet (21) provides the following effect. That is, in the key sheet (21) of this embodiment, the heat diffusion member (17) is embedded in the leg portions (9) of the base sheet (16), so it is possible to prevent the heat diffusion member (17) from being detached from the base sheet (16).

Figure 10:
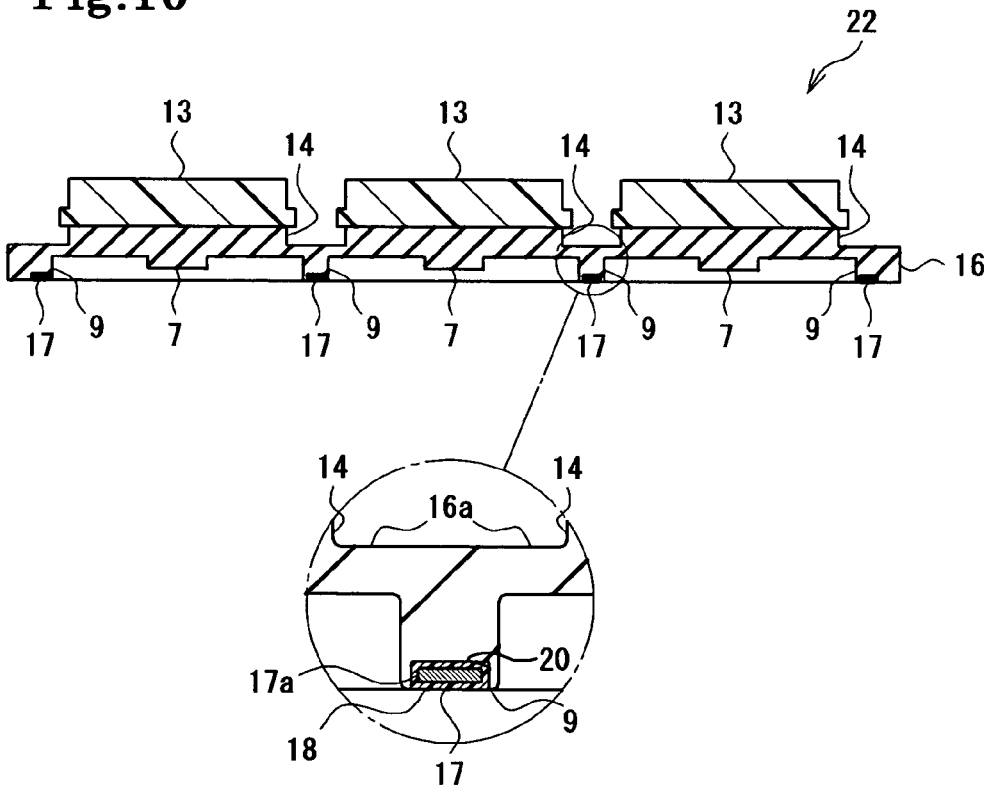
FIG. 10 is a sectional view of a key sheet according to a sixth embodiment.

Sixth Embodiment (FIG. 10)

A key sheet (22) according to a sixth embodiment differs from the key sheet (19) of the fourth embodiment in the structure of the base sheet (16) and the mounting construction for the heat diffusion member (17). Otherwise, the key sheet (22) is of the same construction as the fourth embodiment.

The base sheet (16) is provided with no such fixation recess (20) as seen on the front surface of the base sheet (16) of the fourth embodiment. Instead, at the distal ends of the leg portions (9), there are provided fixation recesses (20) corresponding to the heat diffusion member (17).

The heat diffusion member (17) has the same plan-view configuration as that of the fourth embodiment, and is provided with the polymer protective layer (18) formed of a coating film covering the entire graphite sheet. The heat diffusion layer (17) is bonded to the fixation recesses (20) of the leg portions (9) by adhesion of the base sheet (16). The polymer protective layer (18) may also serve as a light diffusion layer.

Like the key sheet (3) of the first embodiment, the key sheet (22) of the sixth embodiment prevents a malfunction and failure of the semiconductor devices (10) due to heat diffusion, and can meet the requirement for a reduction in the thickness of electronic apparatuses. Further, like the key sheet (19) of the fourth embodiment, the key sheet (22) provides a clear input feel and a rich design property, and can meet the requirement for a reduction in the weight of portable apparatuses. Further, the key sheet (22) provides the following effects.

In the key sheet (22) of this embodiment, the heat diffusion member (17) is covered all over with the polymer protective layer (18). Thus, it is possible to completely prevent detachment of an end portion of the heat diffusion member (17).

In the key sheet (22) of this embodiment, the heat diffusion member (17) is not in direct contact with the board, so the heat diffusion member (17) can be placed as it is without having to cover the board surface with an insulating layer for preventing short-circuiting.

Figure 11:
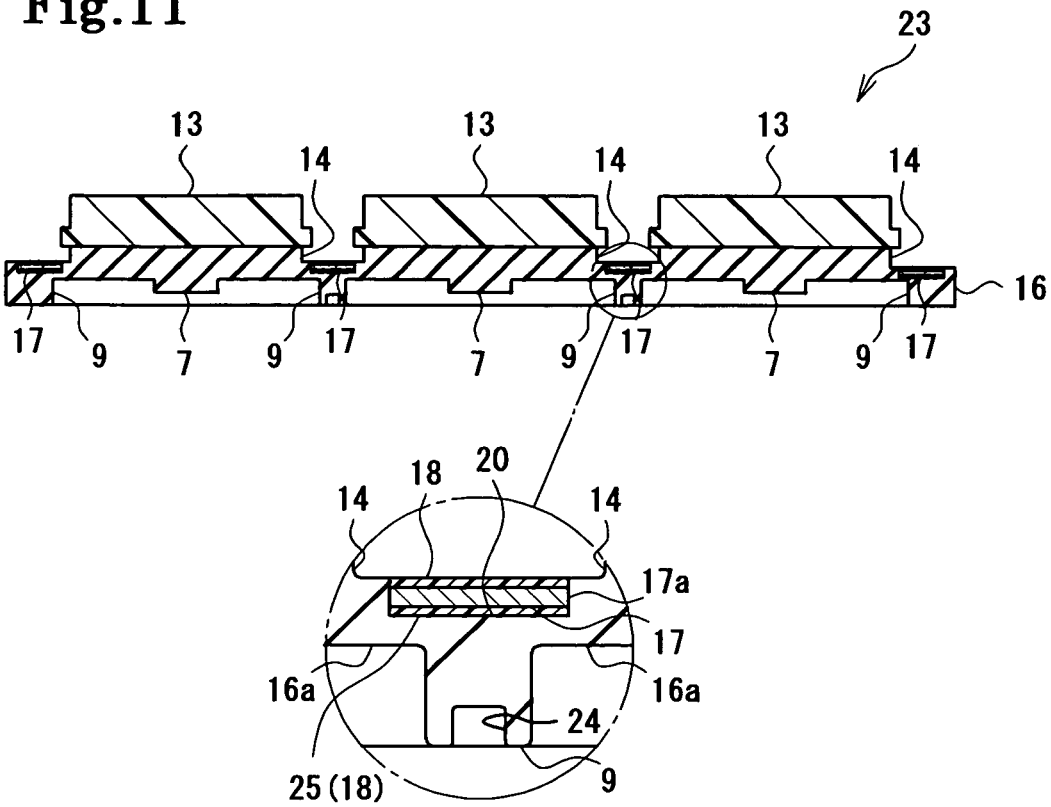
FIG. 11 is a sectional view of a key sheet according to a seventh embodiment.

Seventh Embodiment (FIG. 11)

A key sheet (23) according to a seventh embodiment differs from the key sheet (19) of the fourth embodiment in the structure of the base sheet (16) and of the heat diffusion member (17). Otherwise, the key sheet (23) is of the same construction as the fourth embodiment.

At the distal ends of the leg portions (9) of the base sheet (16), there are provided accommodation recesses (24) for accommodating illumination light sources such as LEDs, arranged on the board (4) (not shown).

The heat diffusion member (17) has the same plan-view configuration as that of the fourth embodiment; the polymer protective layers (18) formed of resin films are attached to the front surface and the back surface of the graphite sheet. The polymer protective layer (18) on the back surface also serves as a light diffusion layer (25). The heat diffusion layer (17) is bonded to the fixation recess (20) on the front surface of the base sheet (16) by adhesion.

Like the key sheet (3) of the first embodiment, the key sheet (23) of the seventh embodiment prevents a malfunction and failure of the semiconductor devices (10) due to heat diffusion, and can meet the requirement for a reduction in the thickness of electronic apparatuses. Further, like the key sheet (19) of the fourth embodiment, the key sheet (23) provides a clear input feel and a rich design property and can meet the requirement for a reduction in the weight of portable apparatuses. Further, the key sheet (23) provides the following effects.

That is, in the key sheet (23) of this embodiment, through-holes (17*a*) provided in the heat diffusion member (17) in correspondence with the pedestal portions (14) of the base sheet (16) constitute light transmission holes. Thus, light emitted from illumination light sources such as LEDs, accommodated in the accommodation recesses (24), passes through the through-holes (17*a*) and is guided to the key tops (13), whereby it is possible to realize an illumination type key sheet.

The key sheet (23) of this embodiment has the light diffusion layer (25) on the back surface of the light diffusion member (17), so when a graphite sheet is used as the light diffusion member (17), the light emitted from the illumination light sources such as LEDs, is caused to undergo diffused reflection by the light diffusion layer (25) before reaching the graphite sheet of a dark color, whereby it is possible to suppress light absorption by the graphite sheet.

Figure 12:
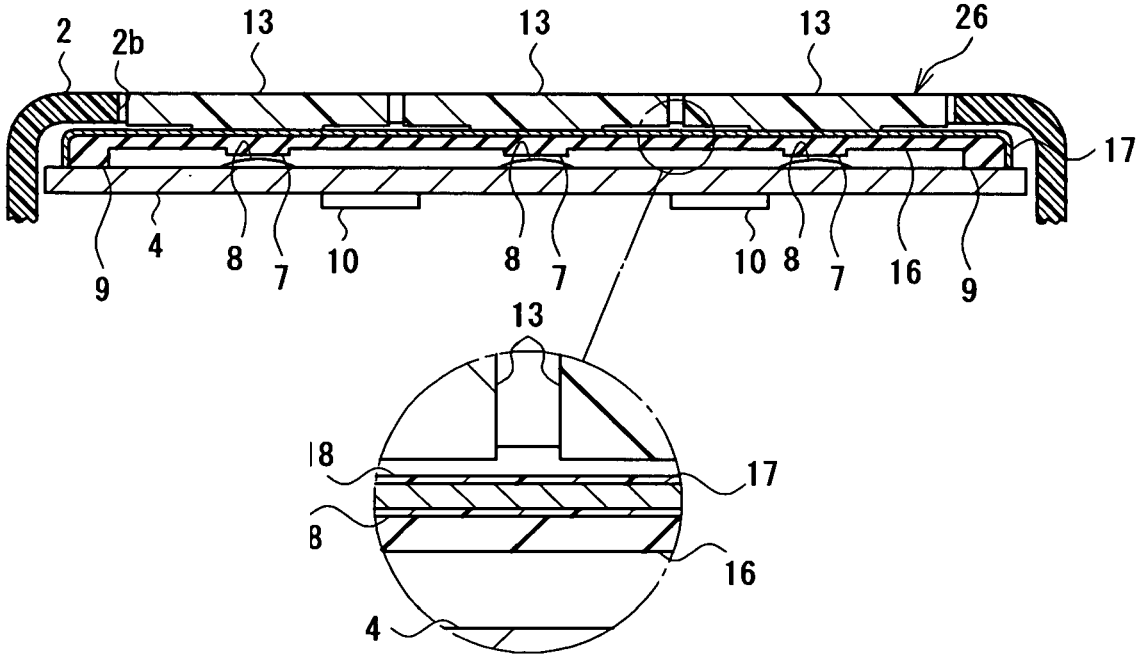
FIG. 12 is a sectional view of a key sheet according to an eighth embodiment.

Eighth Embodiment (FIG. 12)

A key sheet (26) according to an eighth embodiment differs from the key sheet (19) of the fourth embodiment in the structure of the base sheet (16) and of the heat diffusion member (17). Otherwise, the key sheet (26) is of the same construction as the fourth embodiment.

The front surface of the base sheet (16) is formed as a flat surface. On the back surface thereof, there protrudes the leg portion (9) over the entire outer periphery. The distal end of the leg portion (9) is in contact with the front surface of the board (4).

The heat diffusion member (17) is formed of a graphite sheet to the front and back surface of which the polymer protective layers (18) formed of resin films are attached; the heat diffusion member (17) is of the same configuration as the front surface and the outer side surface of the base sheet (16), and covers the entire front surface of the base sheet (16).

Like the key sheet (3) of the first embodiment, the key sheet (26) of the eighth embodiment prevents a malfunction and failure of the semiconductor devices (10) due to heat diffusion, and can meet the requirement for a reduction in the thickness of electronic apparatuses. Further, like the key sheet (19) of the fourth embodiment, the key sheet (26) provides a clear input feel and a rich design property, and can meet the requirement for a reduction in the weight of portable apparatuses. Further, the key sheet (26) provides the following effect. That is, the key sheet (26) has no through-holes in the heat diffusion member (17), and can transmit heat in all directions of 360 degrees throughout the base sheet (16). Thus, it is possible to effect heat diffusion of high efficiency.

Figure 13:
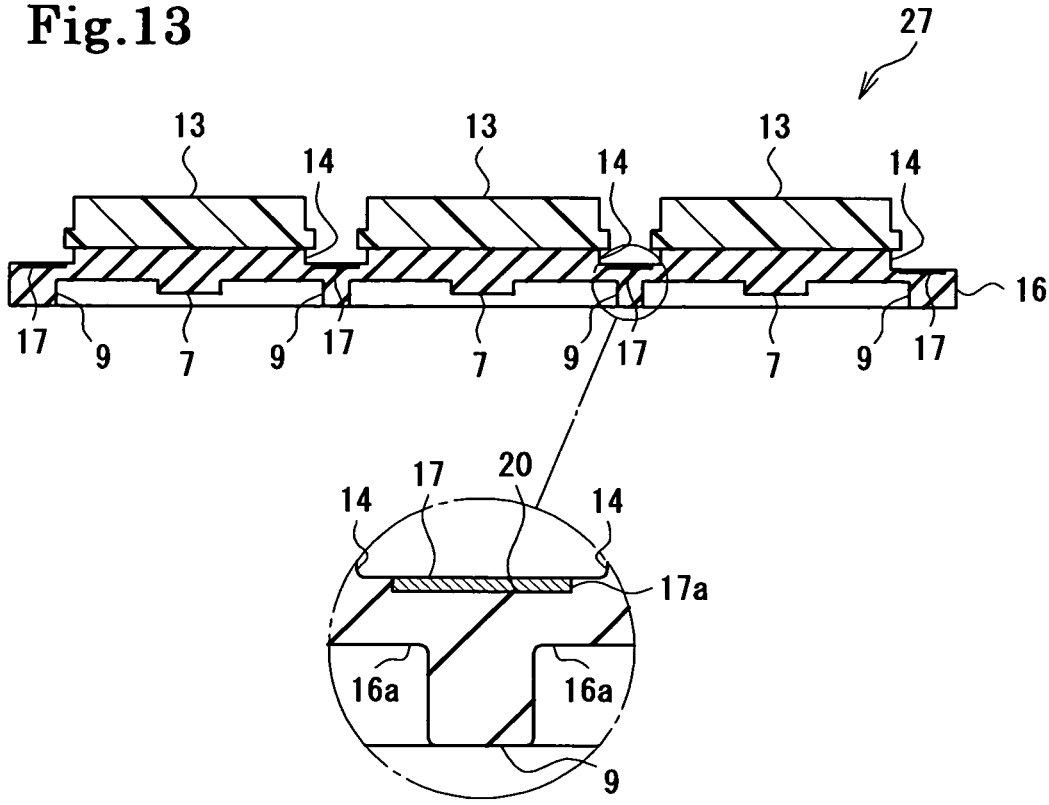
FIG. 13 is a sectional view of a key sheet according to a ninth embodiment.

Ninth Embodiment (FIG. 13)

A key sheet (27) according to a ninth embodiment differs from the key sheet (19) of the fourth embodiment in that the heat diffusion member (17) is formed of a thin metal plate, and that there is provided no polymer protective layer (18) covering the heat diffusion member (17). Otherwise, the key sheet (27) is of the same construction as the fourth embodiment.

The heat diffusion member (17) is formed of a single plate; like the graphite sheet of the fourth embodiment, the outer peripheral edge of the heat diffusion member (17) is somewhat smaller than the outer peripheral edge of the base sheet (16), and has, in correspondence with the pedestal portions (14) of the base sheet (16), the through-holes (17*a*) extending through the thickness thereof. The heat diffusion member (17) is bonded to the fixation recess (20) of the base sheet (16) by adhesion. Since the heat diffusion member (17) formed of a thin metal plate has electrical conductivity, it is desirable to connect the heat diffusion member (17), as in a case of the graphite sheet, to the zero-volt electric power line of the apparatus as a countermeasure against noise.

Here, the material of the thin metal plate will be described. As the material of the thin metal plate, it is possible to use a single metal, such as iron, aluminum, copper, gold, silver, tin, nickel, chromium, or titanium, or an alloy of those metals.

Like the key sheet (3) of the first embodiment, the key sheet (27) of the ninth embodiment prevents a malfunction and failure of the semiconductor device (10) due to heat diffusion, and can meet the requirement for a reduction in the thickness of electronic apparatuses. Further, like the key sheet (19) of the fourth embodiment, the key sheet (27) provides a clear input feel and a rich design property, and can meet the requirement for a reduction in the weight of portable apparatuses. Further, the key sheet (27) provides the following effects. That is, since the heat diffusion member (17) is formed of a thin metal plate, the key sheet (27) has high strength, so there is no need to provide the polymer protective layer (18) contributing to the reinforcement of the heat diffusion member (17). Further, since the thin metal plate has high heat conductivity, it is possible to effect heat diffusion efficiently.

Figure 14:
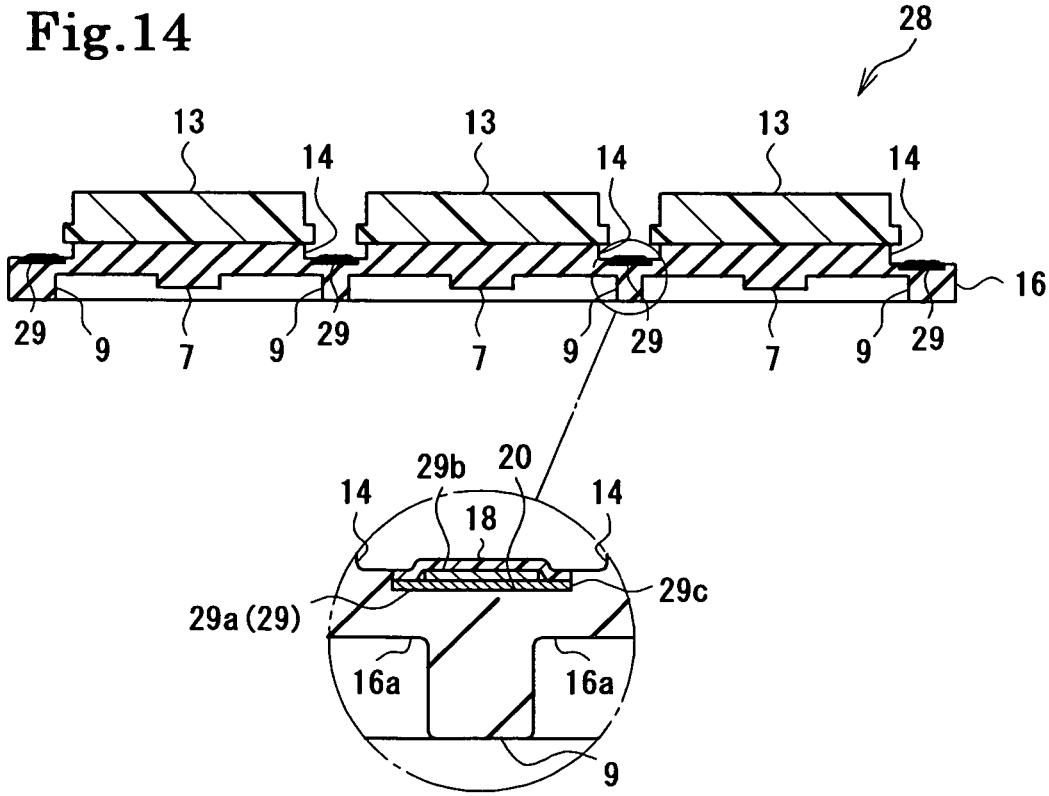
FIG. 14 is a sectional view of a key sheet according to a tenth embodiment.

Tenth Embodiment (FIG. 14)

A key sheet (28) according to a tenth embodiment differs from the key sheet (19) of the fourth embodiment in the structure of a heat diffusion member (29). Otherwise, the key sheet (28) is of the same construction as the fourth embodiment.

In the heat diffusion member (29) of this embodiment, a thin metal plate (29*a*) and a graphite sheet (29*b*) are stacked together such that the graphite sheet (29*b*) constitutes the front surface (i.e., upper surface), and that the thin metal plate (29*a*) constitutes the back surface (i.e., lower surface). The outward configuration of the heat diffusion member (29) is the same as that of the heat diffusion member (17) of the fourth embodiment; the outer edge of the heat diffusion member (29) is somewhat smaller than that of the base sheet (16), and there is are provided, in correspondence with the pedestal portions (14) of the base sheet (16), through-holes (29*c*) extending through the sheet thickness. The heat diffusion member (29) is bonded to the fixation recess (20) of the base sheet (16) by adhesion. In this embodiment, the graphite sheet (29*b*) is on the front surface side, and the polymer protective layer (18) formed of a resin film covers the front surface side of the graphite sheet (29*b*). That is, the graphite sheet (29*b*) is completely sealed by the thin metal plate (29*a*) on the back surface side and the polymer protective layer (18) on the front surface side. Since the thin metal plate (29*a*) and the graphite sheet (29*b*) have electrical conductivity, the polymer protective layer (18) is used as an electrical insulating layer.

Like the key sheet (3) of the first embodiment, the key sheet (28) of the tenth embodiment prevents a malfunction and failure of the semiconductor devices (10) due to heat diffusion, and can meet the requirement for a reduction in the thickness of electronic apparatuses. Further, like the key sheet (19) of the fourth embodiment, the key sheet (28) provides a clear input feel and a rich design property, and can meet the requirement for a reduction in the weight of portable apparatuses. Further, the key sheet (28) provides the following effects. That is, in the key sheet (28) of this embodiment, it is possible to suppress breakage and chipping of the fragile graphite sheet (29*b*) by the thin metal plate (29*a*) having heat conductivity, thereby making it possible to make up for the low physical strength of the graphite sheet (29*b*). Due to the provision of the thin metal plate (29*a*), etc., the heat from the mounted devices is easily conducted through the heat diffusion sheet, thereby making it possible to achieve an improvement in terms of heat diffusion. Further, since the thin metal plate (29*a*) is stacked on the back surface of the graphite sheet (29*b*), it is possible to enhance the heat diffusion in the face direction of the heat diffusion member (29).

Description of embodiments of the double-layer heat diffusion member (29): while there has been described, in connection with the tenth embodiment, an example of the double-layer heat diffusion member (29) in which the thin metal plate (29*a*) and the graphite sheet (29*b*) are stacked together, the heat diffusion member (29) formed of the thin metal plate (29*a*) and the graphite sheet (29*b*) may assume various structures as shown in FIGS. 15A through 15H. In the following, the various structures as shown in FIGS. 15A through 15H will be described.

Figure 15A:
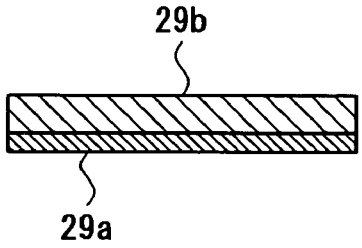
FIGS. 15A through 15H are explanatory views of sheet-like heat diffusion members according to various embodiments.

FIG. 15A shows a form in which only the thin metal plate (29*a*) and the graphite sheet (29*b*) are used as the heat diffusion member (29). When the thin metal plate (29*a*) is stacked on the back surface side of the graphite sheet (29*b*), it is possible to enhance the heat diffusion in the face direction of the graphite sheet (29*b*).

Figure 15B:
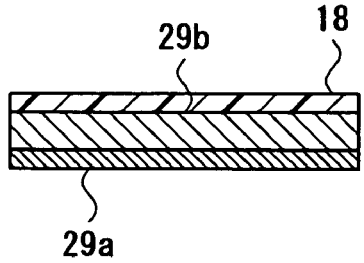

FIG. 15B shows a form in which the heat diffusion member (29) is the same one as used in the tenth embodiment, with the outer surface of the graphite sheet (29*b*) being covered with the polymer protective layer (18). In other words, the graphite sheet (29*b*) is sandwiched between the thin metal plate (29*a*) and the polymer protective layer (18). In this form, the graphite sheet (29*b*) is physically rather fragile and, due to the thin metal plate (29*a*) and the polymer protective layer (18), the graphite sheet (29*b*) does not easily suffer breakage or chipping.

Figure 15C:
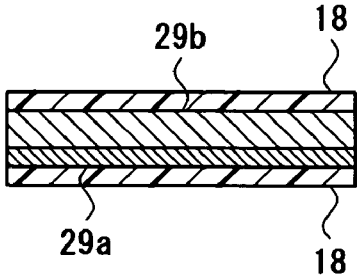

FIG. 15C shows a form in which the upper surface and the lower surface of the heat diffusion member (29) are covered with the polymer protective layers (18). In this form, in addition to the advantage of the form of FIG. 15B, the heat diffusion member (29) does not come into direct contact with the board no matter which of the thin metal plate (29*a*) and the graphite sheet (29*b*) may be opposed to the board, so it is advantageously possible for the heat diffusion member (29) to be placed as it is without subjecting the board surface to a treatment for covering the heat diffusion member (29) with an insulating layer.

Figure 15D:
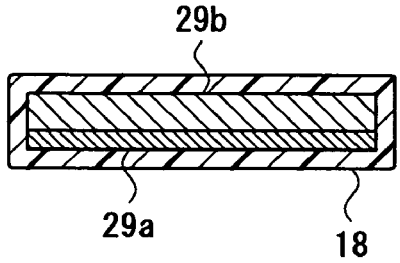

FIG. 15D shows a form in which the heat diffusion member (29) as a whole is covered with a coating layer as the polymer protective layer (18). In this form, the heat diffusion member (29) as a whole is sealed by the polymer protective layer (18), so it is possible to completely prevent detachment of an end portion of the heat diffusion member (29).

Figure 15E:
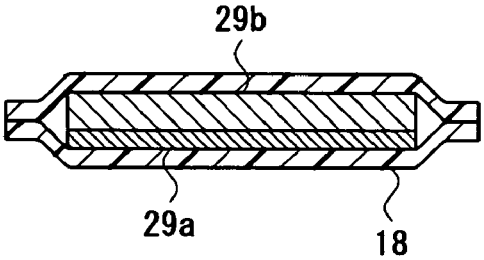

FIG. 15E shows a form in which the heat diffusion member (29) as a whole is sandwiched from above and below by two resin films as the polymer protective layers (18). As in a case of the form shown in FIG. 15D, in this form, it is possible to completely prevent detachment of an end portion of the heat diffusion member (29).

Figure 15F:
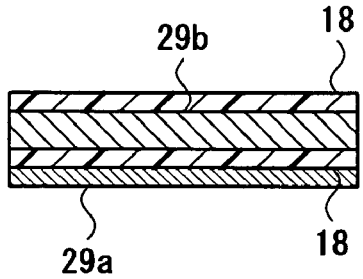

FIG. 15F shows a form in which the upper surface and the lower surface of the graphite sheet (29*b*) is covered with the polymer protective layers (18), with the thin metal plate (29*a*) being stacked on the outer surface thereof. In this form, the thin metal plate (29*a*) is exposed to the exterior, so it is possible to enhance the heat conductivity as compared with the above-mentioned form shown in FIG. 6D.

Figure 15G:
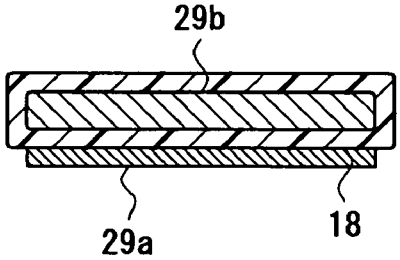

FIG. 15G shows a form in which the graphite sheet (29*b*) as a whole is covered with a coating layer as the polymer protective layer (18), with the thin metal plate (29*a*) being stacked on the outer surface thereof. In this form, the thin metal plate (29*a*) is exposed to the exterior, so it is possible to enhance the heat conductivity as compared with the above-mentioned form shown in FIG. 6E.

Figure 15H:
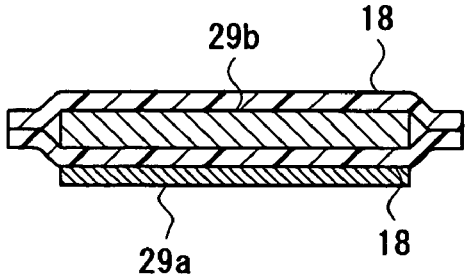
Figure 16:
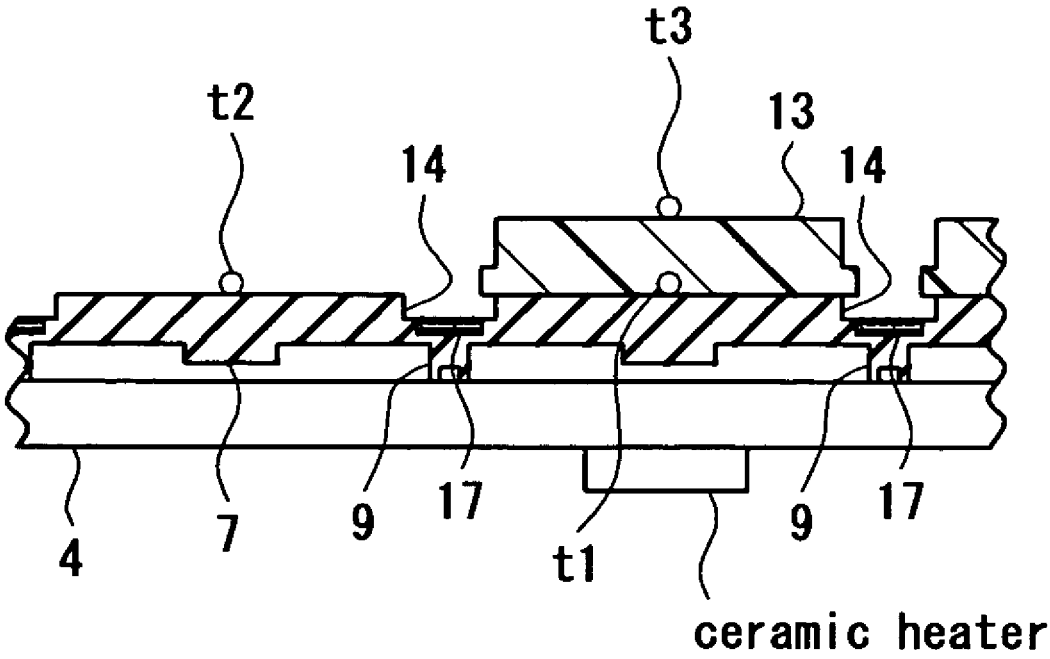
FIG. 16 is a diagram illustrating how heat diffusion characteristic measurement according to an embodiment is conducted.

FIG. 15H shows a form in which the graphite sheet (29*b*) is sandwiched from above and below between two resin films as the polymer protective layers (18), with the thin metal plate (29*a*) being stacked on the outer surface thereof. In other words, it is a laminated structure obtained by stacking the thin metal plate (29*a*) on the unit composed of the graphite sheet (29*b*) and the polymer protective layers (18) covering both surfaces of the same. In this form, the thin metal plate (29*a*) is exposed to the exterior, so it is possible to enhance the heat conductivity as compared with the above-mentioned form shown in FIG. 6F. Further, FIGS. 15A to 15H show that the thin metal plate (29*a*) is laminated on the back surface of the graphite sheet (29*b*), but the thin metal plate (29*a*) may be also laminated on the front surface of the graphite sheet (29*b*). Compared a form in which the thin metal plate (29*a*) is laminated on the back surface and a form in which it is laminated on the front surface, the former form can enhance more heat diffusion efficiency.

As modifications of the fourth through tenth embodiments, it is possible to use, instead of the heat diffusion member (17, 29) as used in those embodiments, the various types of heat diffusion members (17, 29) shown in FIGS. 6A through 6F and FIGS. 15A through 15H.

EXAMPLES

Next, the present invention will be described in more detail with reference to examples and an comparative example, which should not be construed restrictively. As to the key sheet, that of the seventh embodiment described above will be taken up as a typical example.

1. Production of the Key Sheet

Example 1

A graphite sheet having a thickness of 0.13 mm (with heat conductivity in the thickness direction of 7 W/m·K and heat conductivity in the face direction of 240 W/m·K; manufactured by GraphTech International Ltd.) was formed into the heat diffusion member (17) by punching. The outer edge of the heat diffusion member (17) is somewhat smaller than the outer edge of the base sheet (16), and the through-holes (17*a*) extending through the thickness of the base sheet (16) are provided in correspondence with the pedestal portions (14) of the base sheet (16). After inserting the heat diffusion member (17) obtained into the mold for the base sheet (16), a silicone rubber composition was put in the mold to integrate the heat diffusion member (17) simultaneously with the molding of the base sheet (16), thereby forming the base sheet (16) equipped with the heat diffusion member (17). The base sheet (16) is configured so as to have, on the front surface constituting the operating surface, a plurality of pedestal portions (14) serving as the "depression operating portions". Around the pedestal portions (14), there is provided the fixation recess (20) corresponding to the heat diffusion member (17). On the back surface opposed to the board (4), there are formed the columnar pusher portions (7) respectively for the pedestal portions (14), and the leg portions (9) protrude over the entire outer periphery and between the adjacent pedestal portions (14). At the distal ends of the leg portions (9), there are provided the accommodation recesses (24) accommodating LEDs serving as the illumination light sources arranged on the board (4) (not shown). Apart from this, the key tops (13) of polycarbonate resin were formed by injection molding, and the display portions displaying characters, symbols, etc. are formed on the opposing surface of the base sheet (16) by printing. The key tops (13) were bonded to the pedestal portions (14) of the base sheet (16) by adhesion using an ultraviolet setting adhesive to produce the key sheet of Example 1.

The dimensions of the key sheet obtained are as follows: the height as measured from the distal ends of the leg portions (9) of the base sheet (16) to the surfaces of the pedestal portions (14) is 0.7 mm; the thickness of the key tops (13) is 0.7 mm (approximately 1.4 mm as measured from the distal ends of the leg portions (9) of the base sheet (16)); and the distance (pitch) as measured from the center of one key top (13) to the adjacent key top (13) in plan view is 20 mm. The size of the key sheet is approximately 65 mm×40 mm.

Example 2

Polyethylene terephthalate films having a thickness of 0.1 mm were attached to both sides of a graphite sheet similar to that of Example 1 through the intermediation of an acrylic adhesive, and then punching was performed on the whole into the same plan-view configuration as that of Example 1 to thereby form the heat diffusion member (17) having the polymer protective layers (18) on both sides thereof. By using the heat diffusion member (17) obtained, the key sheet of Example 2 was produced in the same process as that of Example 1.

Example 3

A graphite sheet similar to that of Example 1 was punched into the same plan-view configuration as that of Example 1, and was immersed in a two-pack urethane to form the heat diffusion member (17) having the polymer protective layer (18) on the entire surface thereof. By using the heat diffusion member (17) obtained, the key sheet of Example 3 was produced in the same process as that of Example 1.

Example 4

A polyethylene terephthalate film having a thickness of 0.1 mm was attached to one surface of a graphite sheet similar to that of Example 1 through the intermediation of an acrylic adhesive, and a white polyethylene terephthalate film having a thickness of 0.1 mm was attached to the other surface thereof through the intermediation of an acrylic adhesive. Then, punching was performed on the whole into the same plan-view configuration as that of Example 1 to thereby form the heat diffusion member (17) having the polymer protective layers (18) on both sides thereof. The polymer protective layer (17) obtained by attaching the white polyethylene terephthalate film also serves as the light diffusion layer (25). By using the heat diffusion member (17) obtained, the key sheet of Example 4 was produced in the same process as that of Example 1.

Example 5

First, an urethane-type ink in which 30 vol % of titanium oxide and 10 vol % of glass beads were mixed was prepared. Apart from this, there was prepared a silicone rubber composition for the base sheet in which spherical aluminum oxide (having average grain size of 2 μm; manufactured by Micron Co., Ltd.) was mixed in a proportion of 50 vol %. Then, a polyethylene terephthalate film having a thickness of 0.1 mm was attached to one surface of a graphite sheet similar to that of Example 1 through the intermediation of an acrylic adhesive, and a coating film was formed on the other surface thereof by screen printing using the urethane-type ink prepared. After that, punching was performed on the whole into the same plan-view configuration as that of Example 1 to form the heat diffusion member (17) having the polymer protective layers (18) on both sides. The coating film formed with the urethane-type ink also serves as the light diffusion layer (25). By using the heat diffusion member (17) obtained and the silicone rubber composition prepared in Example 5, the key sheet of Example 5 was produced in the same process as that of Example 1.

Example 6

Punching was performed on a graphite sheet in a plan-view configuration in which, as compared with the plan-view configuration of Example 1, the outer edge was somewhat smaller and the through-holes were somewhat larger. A stainless steel plate having a thickness of 0.1 mm was attached to the back surface of this graphite sheet through the intermediation of an acrylic adhesive as the thin metal plate (29*a*), and a polyethylene terephthalate film having a thickness of 0.02 mm was attached to the front surface of the graphite sheet as the polymer protective layer (18). Then, punching was performed on the whole into the same plan-view configuration as that of Example 1 to form the heat diffusion member (29) in which the graphite sheet is completely sealed on the back surface side by the stainless steel plate and on the front surface side by the polyethylene terephthalate film. At the outer edge and the hole edges of the heat diffusion member (29), the stainless steel plate and the polyethylene terephthalate film are bonded to each other, thus sealing the graphite sheet. By using the heat diffusion member (29) obtained, the key sheet of Example 6 was produced by the same method as that of Example 1.

Example 7

The heat diffusion member (29) similar to that of Example 6 was formed by using a copper plate having a thickness of 0.1 mm instead of the stainless steel plate of Example 6. By using the heat diffusion member (29) obtained, the key sheet of Example 7 was produced by the same method as that of Example 1.

Comparative Example 1

The key sheet of Comparative Example 1 was produced by the same method as that of Example 1 except that no heat diffusion member was used.

2. Evaluation of the Key Sheets

The key sheets were measured and evaluated for heat diffusion property, luminance, and bending durability. Table 1 shows the measurement results.

"Heat diffusion property": As a heat source simulating the heat generating semiconductor devices, a ceramic heater ("Microceramic Heater MS-3" (trade name) with heat generating portion having size of 10 mm×10 mm; manufactured by SAKAGUCHI E.H VOC CORP.) was used, and a board (having thickness of 4 mm) was installed at a position upwardly spaced apart from the heat generating portion by 0.6 mm. The above key sheet was placed on this board such that one of the key tops (13) is situated right above the heat generating portion, and then electricity was supplied to the ceramic heater; with a heat generation amount of 1.4 W, the temperature after ten minutes was measured. The positions where temperature measurement was performed were a surface (t1) of the pedestal portion of the base sheet situated right above the ceramic heater, a surface (t2) of the pedestal portion (adjacent pedestal portion) of the base sheet spaced apart from the position of the pedestal portion of the base sheet by 20 mm situated right above the center of the ceramic heater, and a surface (t3) of the key top situated right above the ceramic heater. Table 1 shows the temperatures at the points (t1) through (t3).

"Luminance": The LEDs accommodated in the accommodation recesses (21) were caused to emit light, and the light guided to the display portions was measured by a luminance meter (LS-100, manufactured by KONICA MINOLTA HOLDINGS, INC.). Table 1 shows the measurement values.

"Bending durability": There was conducted a bending test in which a key sheet was repeatedly bent by 90 degrees and restored to the former state every second, counting the number of times the bending had to be performed before a crack was generated in the graphite sheet. Table 1 shows the requisite number of times for generating a crack in each example.

As shown in Table 1, the temperatures (t1) and (t3) in the key sheet of each example are lower than the temperatures (t1) and (t3) in Comparative Example 1, showing that there is no local heat storage.

In the key sheets of Examples 4 and 5, which are equipped with the polymer protective layer (18) also serving as the light diffusion layer (25), the brightness is 2.0 cd/m$^2$ or more, which shows that it is possible to suppress light absorption even if the key sheet is equipped with a black graphite sheet, thus making it possible to effect a clear illumination.

In the key sheets of Examples 6 and 7, which have, on the back surface of the graphite sheet, the thin metal sheet (29*a*) formed of a stainless steel plate, a copper plate or the like, the brightness is 2.0 cd/m$^2$ or more; thus, even if the key sheet is equipped with the black graphite sheet (29*b*), the thin metal plate (29*a*) on the LED side reflects light, thus making it possible to effect a clear illumination.

In the key sheets of Examples 2 through 7, which are equipped with the polymer protective layer (18), a crack is generated after bending has been performed 100 times or more, which shows that the graphite sheet is well protected.

TABLE 1

| | Example 1 | Example 2 | Example 3 | Example 4 | Example 5 | Example 6 | Example 7 | Comparative Example 1 |
|---|---|---|---|---|---|---|---|---|
| Heat diffusion property | | | | | | | | |
| Temperature t1(° C.) | 58 | 62 | 64 | 62 | 53 | 55 | 48 | 82 |
| Temperature t2(° C.) | 37 | 38 | 38 | 37 | 35 | 36 | 34 | 39 |
| Temperature t3(° C.) | 39 | 42 | 42 | 40 | 35 | 37 | 33 | 58 |
| Luminance | | | | | | | | |
| Luminance level ($cd/m^2$) | 1.3 | 1.5 | 1.7 | 2.6 | 2.0 | 2.9 | 3.1 | 2.2 |
| Bending durability | | | | | | | | |
| Number of times of bending to generate crack | 50 | 140 | 180 | 130 | 120 | >200 | >200 | — |

What is claimed is:

1. A key sheet comprising:

a depression operating portion; and a base sheet which is placed on a circuit board with a heat generating electronic component mounted on the circuit board and which is formed of a rubber-like elastic material, wherein the base sheet has a heat diffusion member promoting diffusion of heat generated by the electronic component, and the heat diffusion member has a heat conductive property in itself and promotes diffusion of heat in a face direction of the base sheet.

2. A key sheet according to claim 1, wherein the heat diffusion member is a heat conductive filler mixed in the rubber-like elastic material of the base sheet.

3. A key sheet according to claim 1, wherein the heat diffusion member is a heat conductive filler mixed in the rubber-like elastic material of a leg portion supporting the base sheet on a surface of the board.

4. A key sheet according to claim 1, wherein the heat diffusion member is a thin metal plate with which the base sheet is integrally provided.

5. A key sheet according to claim 4, wherein the heat diffusion member is provided with a polymer protective layer covering at least one surface of the heat diffusion member.

6. A key sheet according to claim 5, wherein the polymer protective layer is a resin film.

7. A key sheet according to claim 5, wherein the polymer protective layer is a light diffusion layer diffusing light from an illumination light source mounted on the board.

8. A key sheet according to claim 5, wherein the polymer protective layer is a coating layer.

9. A key sheet according to claim 1, wherein the heat diffusion member is a thin graphite sheet with which the base sheet is integrally provided.

10. A key sheet according to claim 9, wherein the heat diffusion member is provided with a polymer protective layer covering at least one surface thereof.

11. A key sheet according to claim 10, wherein the polymer protective layer is a resin film.

12. A key sheet according to claim 10, wherein the polymer protective layer is a light diffusion layer diffusing light from an illumination light source mounted on the board.

13. A key sheet according to claim 10, wherein the polymer protective layer is a coating layer.

14. A key sheet according to claim 9, wherein the heat diffusion member is provided with a polymer protective layer covering the heat diffusion member as a whole.

15. A key sheet according to claim 9, wherein the depression operating portion is a key top formed of a translucent resin, wherein the rubber-like elastic material of the base sheet is translucent, and the base sheet has a float-supporting portion supporting the key top to allow displacement though depression, and wherein the heat diffusion member is provided in a portion of the base sheet excluding the float-supporting portion.

16. A key sheet according to claim 4, wherein the heat diffusion member is provided with a polymer protective layer covering the heat diffusion member as a whole.

17. A key sheet according to claim 4, wherein the depression operating portion is a key top formed of a translucent resin, wherein the rubber-like elastic material of the base sheet is translucent, and the base sheet has a float-supporting portion supporting the key top to allow displacement though depression, and wherein the heat diffusion member is provided in a portion of the base sheet excluding the float-supporting portion.

18. A key sheet according to claim 1, wherein the heat diffusion member is a laminate composed of a thin metal plate and a graphite sheet.

19. A key sheet according to claim 18, wherein the heat diffusion member is a laminate in which a thin metal plate is located on the side of a circuit board and a graphite sheet is located on the opposite side of the circuit board.

20. A key sheet according to claim 18, wherein the heat diffusion member is provided with a polymer protective layer covering at least one surface of the heat diffusion member.

21. A key sheet according to claim 20, wherein the polymer protective layer is a resin film.

22. A key sheet according to claim 20, wherein the polymer protective layer is a light diffusion layer diffusing light from an illumination light source mounted on the board.

23. A key sheet according to claim 20, wherein the polymer protective layer is a coating layer.

24. A key sheet according to claim 18, wherein the heat diffusion member is provided with a polymer protective layer covering the heat diffusion member as a whole.

25. A key sheet according to claim 18, wherein the depression operating portion is a key top formed of a translucent resin, wherein the rubber-like elastic material of the base sheet is translucent, and the base sheet has a float-supporting portion supporting the key top to allow displacement though depression, and wherein the heat diffusion member is provided in a portion of the base sheet excluding the float-supporting portion.

* * * * *